United States Patent [19]

Lada

[11] 4,303,345

[45] Dec. 1, 1981

[54] INK RIBBON DRIVE FOR DATA PRINTERS

[75] Inventor: Christopher O. Lada, Ann Arbor, Mich.

[73] Assignee: Sycor, Inc., Ann Arbor, Mich.

[21] Appl. No.: 50,133

[22] Filed: Jun. 20, 1979

[51] Int. Cl.[3] ..... B41J 33/14

[52] U.S. Cl. ..... 400/229; 400/196.1; 400/208; 400/235.1; 400/236; 267/156

[58] Field of Search ..... 400/194, 195, 196, 196.1, 400/208, 229, 235.1, 236, 320, 322, 323, 335, 336, 336.1; 192/21; 267/59, 62, 156, 158

[56] References Cited

U.S. PATENT DOCUMENTS

| | | | |
|---|---|---|---|
| 300,894 | 6/1884 | Randall | 192/21 X |
| 392,610 | 11/1888 | Hoffman | 192/21 |
| 1,977,546 | 10/1934 | Fornelius | 267/156 |
| 2,609,191 | 9/1952 | Foster | 267/156 |
| 2,609,192 | 9/1952 | Lermont | 267/156 |
| 2,714,000 | 7/1955 | O'Connor et al. | 267/156 |
| 2,724,270 | 11/1955 | Trekell | 267/156 X |
| 2,996,264 | 8/1961 | Bygdnes | 267/156 X |
| 3,003,357 | 10/1961 | Votta | 267/156 X |
| 3,167,308 | 1/1965 | Bernstein et al. | 267/156 |
| 3,194,343 | 7/1965 | Sindlinger | 267/156 X |
| 3,283,876 | 11/1966 | Kern | 400/229 X |
| 3,291,474 | 12/1966 | Clarke | 267/156 |
| 3,666,063 | 5/1972 | Schoeman et al. | 192/21 |
| 3,758,012 | 9/1973 | Bonner et al. | 400/196 X |
| 3,834,511 | 9/1974 | Hengelhaupt | 400/235.1 X |
| 3,841,459 | 10/1974 | Buschmann et al. | 400/229 X |
| 3,904,018 | 9/1975 | Denley | 400/229 X |
| 3,910,396 | 10/1975 | Eischen et al. | 400/195 X |
| 3,939,957 | 2/1976 | Bittner | 400/229 X |
| 3,955,809 | 5/1976 | Hara et al. | 267/156 |
| 3,974,906 | 8/1976 | Lee et al. | 400/208 X |
| 4,044,883 | 8/1977 | Boehmer | 400/236 X |

FOREIGN PATENT DOCUMENTS

| | | | |
|---|---|---|---|
| 1046218 | 12/1953 | France | 400/336 |
| 315908 | 10/1956 | Switzerland | 400/336.1 |

OTHER PUBLICATIONS

*IBM Technical Disclosure Bulletin,* "Ribbon Drive", Cross, vol. 15, No. 7, Dec. 1972, p. 2312.

*IBM Technical Disclosure Bulletin,* "Ribbon Drive", Darwin, vol. 19, No. 4, Sep. 1976, pp. 1407–1408.

*Primary Examiner*—Ernest T. Wright, Jr.

*Attorney, Agent, or Firm*—Price, Heneveld, Huizenga & Cooper

[57] ABSTRACT

A ribbon drive for an ink printer ribbon housed in a cartridge and mounted on a reciprocating print head carriage is disclosed. The ribbon drive includes a vertically oriented drive shaft supported on the carriage for rotary motion. A pair of hubs are supported one above the other on the shaft by oppositely operating one-way clutch bearings. Each of the hubs has coiled therearound a constant force, self-coiling band spring. An end of each of the band springs is secured to the printer frame. As the print head carriage translates, the drive shaft is alternately driven by the hubs as the springs wind and unwind therefrom.

13 Claims, 5 Drawing Figures

INK RIBBON DRIVE FOR DATA PRINTERS

BACKGROUND OF THE INVENTION

The present invention relates to ribbon drive systems and more particularly to a drive system for the ink ribbon in a data printer of the type having a bidirectionally movable print heat carriage upon which is mounted a ribbon cartridge.

Various forms of data printers are presently available and which are primarily used to produce printed copy as readout from computer systems. One such printer is commonly referred to as a dot matrix impact printer. This printer includes a carriage supported, multiple-stylus print head which impacts its style against an ink ribbon positioned in front of the paper to be printed. A resilient platen is disposed behind the paper. The carriage and print head are supported on a lead screw drive shaft and a guide or slide rod arrangement in front of the platen. The printer also includes a paper advance mechanism and a logically controlled actuation system. The actuation system causes the carriage and print head to reciprocate bi-directionally across the paper. Such printers have the capability of printing in both directions as the carriage is translated by alternating the direction of rotation of the lead screw drive.

Typically, with printers employing a carriage mounted print head, the inking ribbon is supported directly on the carriage. The ribbon is typically contained in a cartridge and is looped around suitable guides in front of the print head. Provision must be made for driving the inking ribbon.

Various systems have been proposed for mounting and driving the inking ribbon in this type of printer. An example of one such system employs a ribbon cartridge having a supply spool and a takeup spool. The drive mechanism is a fairly delicate pawl and ratchet device and the takeup spool is driven while the carriage translates in one direction only. This arrangement could result in imperfect printing or character definition since the same area of the ink ribbon is struck while the carriage moves across the entire base of the platen.

Another ribbon drive includes a shaft extending through a support bracket secured to the printer carriage. One of the shafts is rotated in alternating directions as the carriage translates back and forth during printing and a friction wheel output is rotated in a single direction during printer translation. A gear and one-way bearing arrangement is operatively associated with the shaft for uni-directionally rotating the friction wheel output as the carriage moves back and forth.

U.S. Pat. No. 3,758,012, entitled *CONTROL TENSION RIBBON CASSETTE* and issued on Sept. 11, 1973 to Bonner et al discloses another form of ribbon drive. The drive disclosed therein includes a pressure roll mounted on a vertically oriented shaft and which is rotatably mounted on a cassette support portion of a printer carriage. A pair of toothed drive wheels or gears are secured to the shaft by oppositely operating one-way clutches. Flexible rack belts engage the drive wheels causing them to rotate and alternately drive the shaft uni-directionally.

Another ribbon drive which is similar to that disclosed in the aforementioned Bonner et al patent is shown in *IBM Technical Disclosure Bulletin,* to R. G. Cross Vol. 15, No. 7, page 2312 dated December 1972. A pair of hubs or spools are supported on a vertical drive shaft by oppositely operated one-way clutches. A rope or cord is wrapped around each of the hubs and around fixed pegs. The ends of the cord are fixed to the printer frame. Due to the direction of wrap of the rope or cord about both hubs, the shaft is driven in one direction as a print head moves in a back and forth manner.

The prior systems suffer from various problems relating to weight, cost and space requirement problems. The prior systems employing one or more rack belts require that special steps be taken to maintain the belt in driving engagement with the toothed wheel or gear. The same problems are experienced with the cord type of device since it must be stretched or maintained in tension to insure that the driving relationship is maintained between the cord and the bearing supported hubs.

A need, therefore, exists for a drive system for a carriage mounted ink ribbon cartridge having the capability of uni-directionally driving the ribbon while the carriage translates in both a forward and reverse direction and whereby the problems heretofore experienced are substantially alleviated.

SUMMARY OF THE INVENTION

In accordance with the present invention, a simple, easily manufactured highly reliable ribbon drive is provided for use with a two-way, relatively high speed printer. Essentially, the ribbon drive includes a drive shaft rotatably supported on a print head carriage. A pair of hubs are supported one above the other on the drive shaft by oppositely operating one-way clutches. Constant force, self-coiling springs are coiled around the hubs. One end of each of the springs is fixed to the printer frame. As the carriage translates, the spring on one of the hubs will unwind thereby rotating the shaft through its one-way bearing. The other spring will wind on its hub which is freely rotating on the shaft. The shaft is driven uni-directionally regardless of the direction of carriage movement.

The drive in accordance with the present invention has relatively few parts and provides the significant advantages of high reliability, ease of manufacture and consequent cost economies. The problems heretofore experienced with maintaining operative engagement between a gear and a rack belt or between a hub and a rope or cord are eliminated.

DETAILED DESCRIPTION OF THE PREFERRED EMBODIMENT

Figure 1:
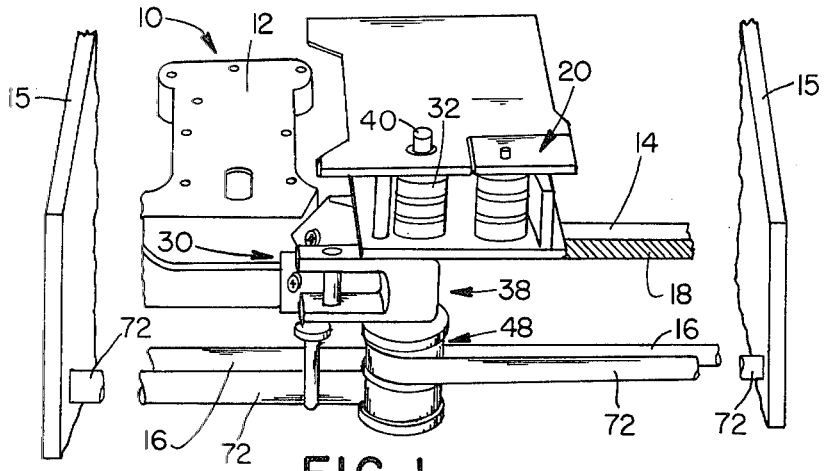
FIG. 1 is a fragmentary, front elevational view of a printer including a ribbon drive in accordance with the present invention.
Figure 2:
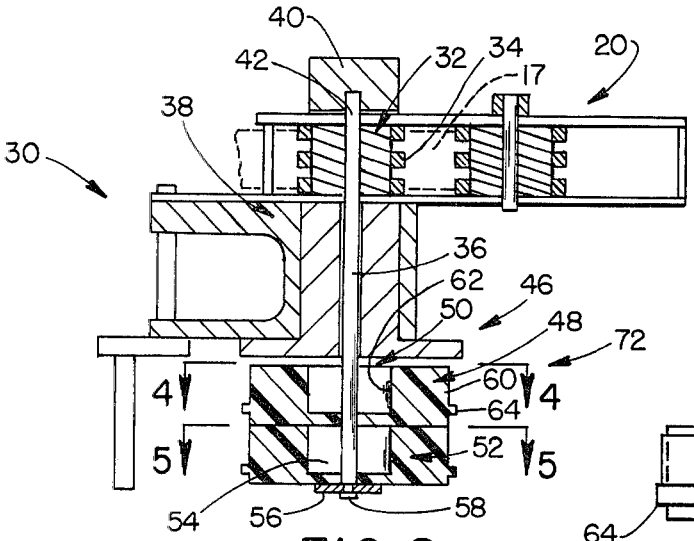
FIG. 2 is a sectional, elevational view of the ribbon drive.

With reference to the drawing, FIG. 1 illustrates a portion of a dot matrix printer generally designated 10 and for which the present invention is readily adapted. The printer 10 includes a carriage 12 upon which a print head (not shown) is mounted. The carriage 12 is suspended on guide rods 14, 16 which extend between side plates 15 which form a portion of the frame of the printer 10. The carriage 12 is translated back and forth along rods 14, 16 by a lead screw 18. An inking ribbon cartridge of conventional form is generally designated 20 in FIGS. 1 and 2. Cartridge 20 is of the continuous looped type. An inking ribbon schematically shown in FIG. 2 and designated 17 is pulled outwardly from the cartridge 20 and entrained around ribbon guard guides (not shown) supported on the carriage 12. The ribbon 17 is then pushed or stuffed back into a return opening of the cartridge 20 and which is hidden from view in the drawing. The ribbon 17 may be struck by impact hammers or wires, as the case may be, of the print head which are conventional and are not shown in the drawing.

The particular printer arrangement 10 should be considered as only one example of the type of commercially available apparatus for which the present invention is suited. Many other printers are available which use a reciprocating bi-directionally movable head or carriage. The subject matter of the present invention may also be incorporated in such machines.

A ribbon drive, generally designated 30, in accordance with the present invention engages the ribbon 17 and moves the ribbon 17 past the print head. The drive 30 includes a friction wheel or capstan 32 having resilient elements 34 which engage the ribbon 17. The capstan 32 is nonrotatably fixed to a generally vertically oriented shaft 36. Shaft 36 extends through a support bracket 38 which is secured to the carriage 12 or formed integrally with the carriage 12. A manual adjustment knob 40 is secured to an upper end 42 of shaft 36. Drive 30 in accordance with the present invention continuously rotates capstan 32 in a single direction while the print head carriage 12 reciprocates back and forth during printer operation.

The uni-directional rotation of capstan 32 is accomplished by a rotary motion input means generally designated 46. Means 46 includes a first or upper hub 48 supported on shaft 36 by a one-way clutch bearing 50. Positioned below hub 48 is another hub 52 similarly supported on shaft 36 by a one-way clutch bearing 54. Clutch bearings or one-way clutches 50, 54 are identical but oppositely operating elements. Shaft 36 is held in position relative to the bracket 38 by a clip 56 carried at a lower end 58 of the shaft 36 and by the capstan 32 at the upper end of the shaft 36. A washer or other bearing type element (not shown) may be positioned between the capstan 32 and the top of the bracket 38 and through which shaft 36 extends.

Figure 3:
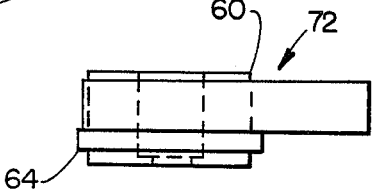
FIG. 3 is an elevational view of a hub supporting a constant force spring and which is employed in the present invention.
Figure 4:
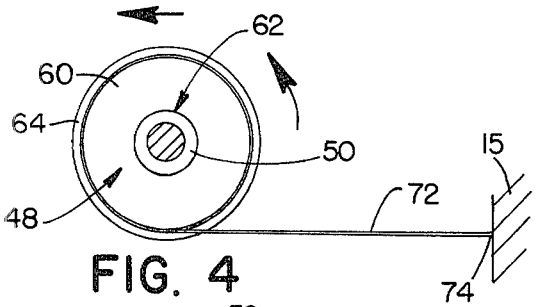
FIG. 4 is a sectional view taken generally along line 4—4 of FIG. 2.
Figure 5:
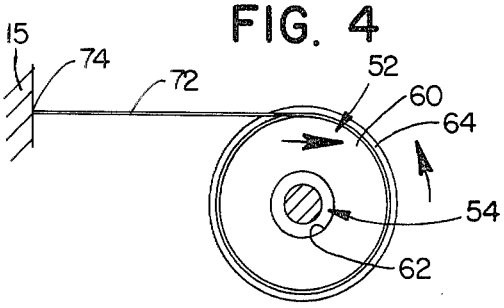
FIG. 5 is a sectional view taken generally along line 5—5 of FIG. 2.

As seen in FIGS. 3, 4 and 5, each of the hubs 48, 52 is circular in plan and includes a generally cylindrical portion 60 having a counter bore 62. Extending radially outwardly from each cylindrical portion 60 is a flange 64. One-way bearings or clutches 50, 54 are disposed within bores 62 of hubs 48, 52, respectively. Each one-way clutch 50, 54 is press fit within its respective bore 62. In accordance with the present invention, each hub 48, 52 has coiled thereon a self-coiling, constant force, metal band type spring 72. Each spring 72 rests on flange 64 of its respective hub 48, 52. The internal diameter of each coiled spring 72 is slightly less than the outer diameter of portions 60 of each hub 48, 52. The springs 72 must be slightly uncoiled or expanded to slip onto the hubs 48, 52. Spring 72 supported on hub 48 has an end 74 secured to the printer side plate 15 adjacent the righthand side thereof when viewed in FIG. 1. Spring 72 coiled around hub 52 has its end 74 secured to the opposite side or left side of the printer 10 when viewed in FIG. 1. This is also clearly seen in FIGS. 4 and 5. The opposite ends of coils springs 72 merely engage the outer surface of cylindrical portions 60 of hubs 48, 52. Due to the tension and consequent frictional force generated by the spring 72 as it coils about its hub 48, 52, there is no need to stake or fix the spring end 74 to its hub 48, 52.

As the carrage 12 is translated by the lead screw 18, support bracket 38 will move therewith. When the carriage 12 moves to the left when viewed in FIG. 1 and FIG. 4, one-way bearing 50 will lock onto or engage the shaft 36 causing rotary movement of hub 48 to be transmitted to the shaft 36 and hence to the capstan 32. Coil spring 72 on hub 48 will unwind from the hub 48 causing the hub 48 to rotate in a counterclockwise direction as viewed in FIG. 4. While rotary motion is being transmitted to the shaft 36 by the hub 48 and bearing 50, hub 52 is freely rotating in a clockwise direction when viewed in FIG. 5 and coil spring 72 is self-coiling on hub 52.

As the direction of movement of the print head carriage 12 shifts from the left to the right when viewed in FIG. 1, bearing 54 will then lock on or engage shaft 36 and bearing 50 will unlock or unclutch allowing hub 48 to freely rotate on shaft 36. Hub 52 is rotated in a counterclockwise direction when viewed in FIG. 5 as the coil spring 72 is being unwound therefrom due to the movement of print head carriage 12. As a result, the shaft 36 and hence capstan 32 is rotated in a counterclockwise direction or the same direction of rotation as caused by hub 48 and its spring 72 during movement of the carriage 12 to the left. Uni-directional movement of capstant 32 is obtained during bi-directional movement of the carriage 12 during printer operation.

If it is necessary to advance the ribbon 17 when the print head is not being translated, an operator need merely grasp knob 40 and rotate the shaft 36 in a counterclockwise direction. Since the coil springs 72 are not fixed to their respective hubs 48, 52, the hubs 48, 52 may rotate relative to the springs 72. Thus, manual adjustment is easily accomplished. Springs 72 obviate the problems heretofore experienced with maintaining a toothed or rack belt in engagement with a gear wheel supported on one-way bearings on a shaft. The self-coiling and constant force characteristics of the springs 72 insure that the respective hubs 48, 52 are driven during translation of the carriage 12. The springs 72 are easily mounted on the hubs 48, 52 and the assembly of the drive 30 in accordance with the present invention is significantly easier than the assembly of the prior drives.

Readily available, "off the shelf", constant force self-coiling springs will only provide several thousand cycles of operation. This is not acceptable in the context of a data printer. It has been discovered that to achieve the required reliability and operational life, each band spring 72 should be fabricated with a thickness of approximately 0.004 inches and a coiled internal diameter of 1.00 inch. Fabricating the springs 72 so that they are fairly thin and have a fairly large diameter reduces significantly the stresses imposed on the springs 72 during operational cycling. Further, the springs 72 are fabricated from a high strength stainless steel and preferably AISI 302 stainless. Such a material provides the necessary stress life and reliability. The width or transverse dimension of each band spring 72 has been found not to be critical to achieving acceptable life for the springs 72. With springs 72 in accordance with the preferred embodiment when used with hubs 48, 52 having an outer diameter of approximately 1.15 inches, a minimum of three to four million cycles of operation are achieved. The springs 72 are dimensioned longitudinally so that approximately 1 to 1½ turns or wraps are made around the hubs 48, 52 when the springs 72 are uncoiled at the maximum travel of the print head carriage 12. This insures that the nonstaked end of the spring 72 will be retained on the larger diameter hub 48, 52.

The drive arrangement 30 of the present invention is readily adaptable to a variety of print head carriages. The one-way roller clutch bearings 50, 54 are readily available, inexpensive items. The drive support bracket or housing 38 may be inexpensively molded from plastic material and is readily secured to a print head carriage 12. The drive arrangement 30 is relatively simple in construction, extremely reliable in service and can withstand the forces imposed on it during high speed printer operation. The ribbon 17 contained within cartridge 20 is continuously advanced regardless of the direction of translation or movement of the print head carriage 12. This insures that the impact hammers or style, as the case may be, always strike a continuously changing surface on the ribbon 17. The one-way bearings 50, 54 and the hubs 48, 52 are mounted concentric with the drive shaft 36 thereby reducing the space requirements of the ribbon drive 30 to a minimum.

In view of the foregoing description, those of ordinary skill in the art will undoubtedly envision various modifications which would not depart from the inventive concepts disclosed herein. For example, the drive could be employed to drive the takeup spool of a two spool or other such ribbon apparatus. In such event, the upper end of the drive shaft 36 would be secured directly to the drive hub of a takeup spool. Such an alternative is not illustrated in the drawing. Further, when used with a ribbon cartridge 20 of the endless loop type, the capstan or friction drive output 32 could be formed with a single, cylindrical friction surface member or in other ways as may be desired. It is expressly intended, therefore, that the above description should be considered as that of the preferred embodiment only. The true spirit and scope of the present invention may be determined by reference to the appended claims.

The embodiments of the invention in which an exclusive property or privilege is claimed are defined as follows:

1. In a printer of the type having a frame, a carriage, means for translating the carriage back and forth, support means for mounting a ribbon cartridge to contain a ribbon, and ribbon drive means to engage the ribbon for driving the ribbon as the carriage translates back and forth, wherein the improvement comprises said ribbon drive means comprising:

a vertically oriented drive shaft supported on said carriage for rotary motion;

a first hub supported on the shaft by a one-way bearing;

a first constant-tension, coiled band spring coiled around said first hub and having one end secured to the frame;

a second hub supported on the shaft by another one-way bearing; and a second constant-tension, coiled band spring coiled around said second hub and having one end secured to the frame whereby the drive shaft is driven in one direction alternately by said first and second hubs as the carriage translates back and forth, each of said constant-tension, coiled band springs having a thickness of approximately 0.004 inches.

2. A printer as defined by claim 1 wherein each of said constant-tension, coiled band springs has a coiled, internal diameter of approximately 1.00 inch and each of said hubs is circular in plan and has a diameter greater than the internal diameter of said springs.

3. A ribbon drive for a data printer of the type having a laterally reciprocable print head carriage upon which is mounted a ribbon cartridge containing a ribbon, said ribbon drive comprising:

a support member;

a drive shaft rotatably supported on said support member;

an output means secured to said drive shaft for engaging the ribbon and moving the ribbon;

a pair of hubs supported one above the other on said drive shaft by oppositely operating one-way clutches, each of said hubs including a cylindrical portion and a circular radially extending flange;

a first constant-force self-coiling spring coiled around the cylindrical portion of one of said hubs, whereby when an end of the spring is fixed to the data printer and the carriage translates in one direction, the spring will unwind and rotate the drive shaft through said one of said hubs; and a second constant-force, self-coiling spring freely coiled around the cylindrical portion of the other of said hubs whereby when an end of said second spring is fixed to the data printer and the carriage translates in the other direction, the second spring will unwind and rotate the drive shaft through said other of said hubs and said first spring will coil onto said one of said hubs.

4. A ribbon drive as defined by claim 3 wherein each of said springs is fabricated from a high strength stainless steel.

5. A ribbon drive as defined by claim 3 wherein the cylindrical portion of each of said hubs has diameter greater than 1.00 inch and the springs have a coiled internal diameter of approximately 1.00 inch and less than the diameter of the cylindrical portion of said hubs.

6. A ribbon drive as defined by claim 5 wherein each of said springs has a thickness of approximately 0.004 inches.

7. A ribbon drive as defined by claim 3 wherein said springs are fabricated from high-strength stainless steel, have a thickness of approximately 0.004 inches and a coiled internal diameter of approximately 1.00 inch.

8. In a printer of the type having a frame, a carriage, a ribbon cartridge to contain a ribbon operatively supported by the carriage, drive means for translating said carriage, and wherein the improvement comprises:

ribbon drive means operatively connected to the ribbon cartridge for driving the ribbon, said ribbon drive means including:

a vertically oriented drive shaft;

means on the printer for supporting said drive shaft for rotary motion;

a one-way bearing on said drive shaft;

a circular hub having a central aperture within which said one-way bearing is disposed to thereby support said hub;

a constant-tension, coiled, metal band spring, said spring being coiled around said hub and having a free end fixed to said frame so that as said carriage translates, said spring coils and uncoils on said hub so that said drive shaft rotates in one direction; and means operatively connected to said drive shaft for engaging the ribbon to drive said ribbon as said drive shaft is rotated.

9. In a printer as defined by claim 8 wherein said constant tension, coiled metal band spring has a coiled internal diameter less than the diameter of said hub and said hub further includes a circular, radially extending flange.

10. In a printer as defined by claim 9 wherein said spring is fabricated from high strength stainless steel, has a thickness of approximately 0.004 inches and a coiled internal diameter of approximately 1.00 inch and wherein said hub has a diameter greater than 1.00 inch.

11. In a printer of the type having a frame, a carriage, means for translating the carriage back and forth, support means for mounting a ribbon cartridge to contain a ribbon and ribbon drive means to engage the ribbon for driving the ribbon as the carriage translates back and forth, wherein the improvement comprises said ribbon drive means comprising:

a vertically oriented drive shaft supported on said carriage for rotary motion;

a first hub supported on the shaft by a one-way bearing;

a first, high-strength, stainless steel, constant-tension, coiled band spring coiled around said first hub and having one end secured to the frame;

a second hub supported on the shaft by another one-way bearing; and a second, high-strength, stainless steel, constant-tension, coiled band spring coiled around said second hub and having one end secured to the frame whereby the drive shaft is driven in one direction alternately by said first and second hubs as the carriage translates back and forth, each of said constant-tension, coiled band springs having a thickness of approximately 0.004 inches, and a coiled, internal diameter of approximately 1.00 inch and each of said hubs being circular in plane and having a diameter greater than the internal diameter of said springs.

12. A ribbon drive for a data printer of the type having a laterally reciprocable print head carriage upon which is mounted a ribbon cartridge containing a ribbon, said ribbon drive comprising:

a support member;

a drive shaft rotatably supported on said support member;

an output means secured to said drive shaft for engaging the ribbon and moving the ribbon;

a pair of hubs supported one above the other on said drive shaft by oppositely operating one-way clutches, each of said hubs including a cylindrical portion having a diameter greater than 1.00 inch and a circular radiallyextending flange;

a first, high-strength, stainless steel, constant-force, self-coiling spring having a thickness of approximately 0.004 inches and a coiled internal diameter of approximately 1.00 inch coiled around the cylindrical portion of one of said hubs, whereby when an end of the spring is fixed to the data printer and the carriage translates in one direction, the spring will unwind and rotate the drive shaft through said one of said hubs; and a second, high-strength, stainless steel, constant-force, self-coiling spring having a thickness of approximately 0.004 inches and a coiled internal diameter of approximately 1.00 inch freely coiled around the cylindrical portion of the other of said hubs whereby when an end of said second spring is fixed to the data printer and the carriage translates in the other direction, the second spring will unwind and rotate the drive shaft through said other of said hubs and said first spring will coil onto said one of said hubs.

13. A ribbon drive for a data printer of the type having a laterally reciprocable print head carriage upon which is mounted a ribbon cartridge containing a ribbon, said ribbon drive comprising:

a support member;

a drive shaft rotatably supported on said support member;

an output means secured to said drive shaft for engaging the ribbon and moving the ribbon;

a pair of hubs supported one above the other on said drive shaft by oppositely operating one-way clutches, each of said hubs including a cylindrical portion and a circular radially extending flange;

a first constant-force, self-coiling spring coiled around the cylindrical portion of one of said hubs, whereby when an end of the spring is fixed to the data printer and the carriage translates in one direction, the spring will unwind and rotate the drive shaft through said one of said hubs; and a second constant-force, self-coiling spring freely coiled around the cylindrical portion of the other of said hubs whereby when an end of said second spring is fixed to the data printer and the carriage translates in the other direction, the second spring will unwind and rotate the drive shaft through said other of said hubs and said first spring will coil onto said one of said hubs, each of said constant-force, self-coiling springs having a nominal, coiled, internal diameter and each of said cylindrical portions having a diameter greater than the nominal, coiled, internal diameter of said springs, whereby said springs must be slightly uncoiled or expanded to slip onto said cylindrical portions.

* * * * *